US010407810B2

(12) United States Patent
Chen et al.

(10) Patent No.: US 10,407,810 B2
(45) Date of Patent: Sep. 10, 2019

(54) OPERATING METHOD FOR COMPUTERIZED EMBROIDERY MACHINE

(71) Applicant: Zeng Hsing Industrial Co., Ltd., Taichung (TW)

(72) Inventors: Chia-Hung Chen, Taichung (TW); Wei-Lun Chen, Taichung (TW)

(73) Assignee: Zeng Hsing Industrial Co., Ltd., Taichung (TW)

( * ) Notice: Subject to any disclaimer, the term of this patent is extended or adjusted under 35 U.S.C. 154(b) by 261 days.

(21) Appl. No.: 15/670,927

(22) Filed: Aug. 7, 2017

(65) Prior Publication Data

US 2019/0040557 A1 Feb. 7, 2019

(51) Int. Cl.

| | |
|---|---|
| ***D05B 19/02*** | (2006.01) |
| ***D05B 19/14*** | (2006.01) |
| ***D05B 19/08*** | (2006.01) |
| *D05B 19/16* | (2006.01) |

(52) U.S. Cl.

CPC ..... *D05B 19/085* (2013.01); *D05B 19/14* (2013.01); *D05B 19/16* (2013.01)

(58) Field of Classification Search

CPC ..... D05B 19/00; D05B 19/16; D05B 19/085; D05C 1/00; G06F 3/00; G06F 3/002

See application file for complete search history.

(56) References Cited

U.S. PATENT DOCUMENTS

| | | | | |
|---|---|---|---|---|
| 5,283,748 | A * | 2/1994 | Muramatsu | D05B 19/08 112/102.5 |
| 5,383,413 | A * | 1/1995 | Hayashi | D05B 19/10 112/102.5 |
| 5,671,410 | A * | 9/1997 | Mizuno | D05B 19/04 |
| 5,677,843 | A * | 10/1997 | Mizuno | D05B 19/04 112/475.19 |
| 5,954,004 | A * | 9/1999 | Futamura | D05B 19/105 112/102.5 |
| 6,925,351 | B2 * | 8/2005 | Larson | D05B 19/06 700/138 |
| 2014/0324210 | A1 * | 10/2014 | Mizuno | D05B 19/12 700/138 |

* cited by examiner

*Primary Examiner* — Ismael Izaguirre
(74) *Attorney, Agent, or Firm* — DLA Piper LLP (US)

(57) ABSTRACT

An operating method for computerized machine embroidery includes steps of: (a) transmitting two portions of the stitch data sets respectively into a first storage section and a second storage section; (b) embroidering according to the portion of the stitch data sets in the first storage section; (c) after completion of step (b), the embroidery machine erasing data from the first storage section; (d) after completion of step (c), the transmitting a remaining portion of the stitch data sets to the first storage section; (e) after completion of step (b), embroidering according to the portion of the stitch data sets in the second storage section; and (f) repeating step (b) after completion of steps (d) and (e).

10 Claims, 4 Drawing Sheets

OPERATING METHOD FOR COMPUTERIZED EMBROIDERY MACHINE

FIELD

The disclosure relates to an operating method for a computerized embroidery machine.

BACKGROUND

A computerized embroidery machine is a device to create a certain pattern on a fabric according to a stitch file. Conventionally, a user may operate an electronic device such as a computer to design an embroidery pattern by use of embroidery software, to convert the designed pattern into a stitch file, and to transmit the stitch file to a computerized embroidery machine that is configured with random access memory (RAM) to temporarily store the stitch file for execution by the computerized embroidery machine. The capacity of the RAM imposes a restriction on the file size of the stitch file that can be executed by the computerized embroidery machine. A low-end computerized embroidery machine which only has limited RAM capacity due to cost concerns may be unable to process a stitch file for a fine, gorgeous, complicated embroidery pattern due to the overly large file size thereof, and be limited to embroidering only simple patterns.

SUMMARY

Therefore, an object of the disclosure is to provide an operating method for computerized embroidery machine that may overcome the drawback of the prior art.

According to the disclosure, the operating includes steps of: (a) an electronic device transmitting stitch data sets of a stitch file to an embroidery machine, and the embroidery machine storing two portions of the stitch data sets respectively into a first storage section and a second storage section; (b) the embroidery machine embroidering according to the portion of the stitch data sets that is stored in the first storage section; (c) after completion of step (b), the embroidery machine erasing the portion of the stitch data sets from the first storage section; (d) after completion of step (c), the electronic device transmitting a remaining portion of the stitch data sets to the embroidery machine, and the embroidery machine storing the remaining portion of the stitch data sets into the first storage section; (e) after completion of step (b), the embroidery machine embroidering according to the portion of the stitch data sets that is stored in the second storage section; and (f) repeating step (b) after completion of steps (d) and (e).

BRIEF DESCRIPTION OF THE DRAWINGS

Other features and advantages of the disclosure will become apparent in the following detailed description of the embodiment (s) with reference to the accompanying drawings, of which.

DETAILED DESCRIPTION

Figure 1A:
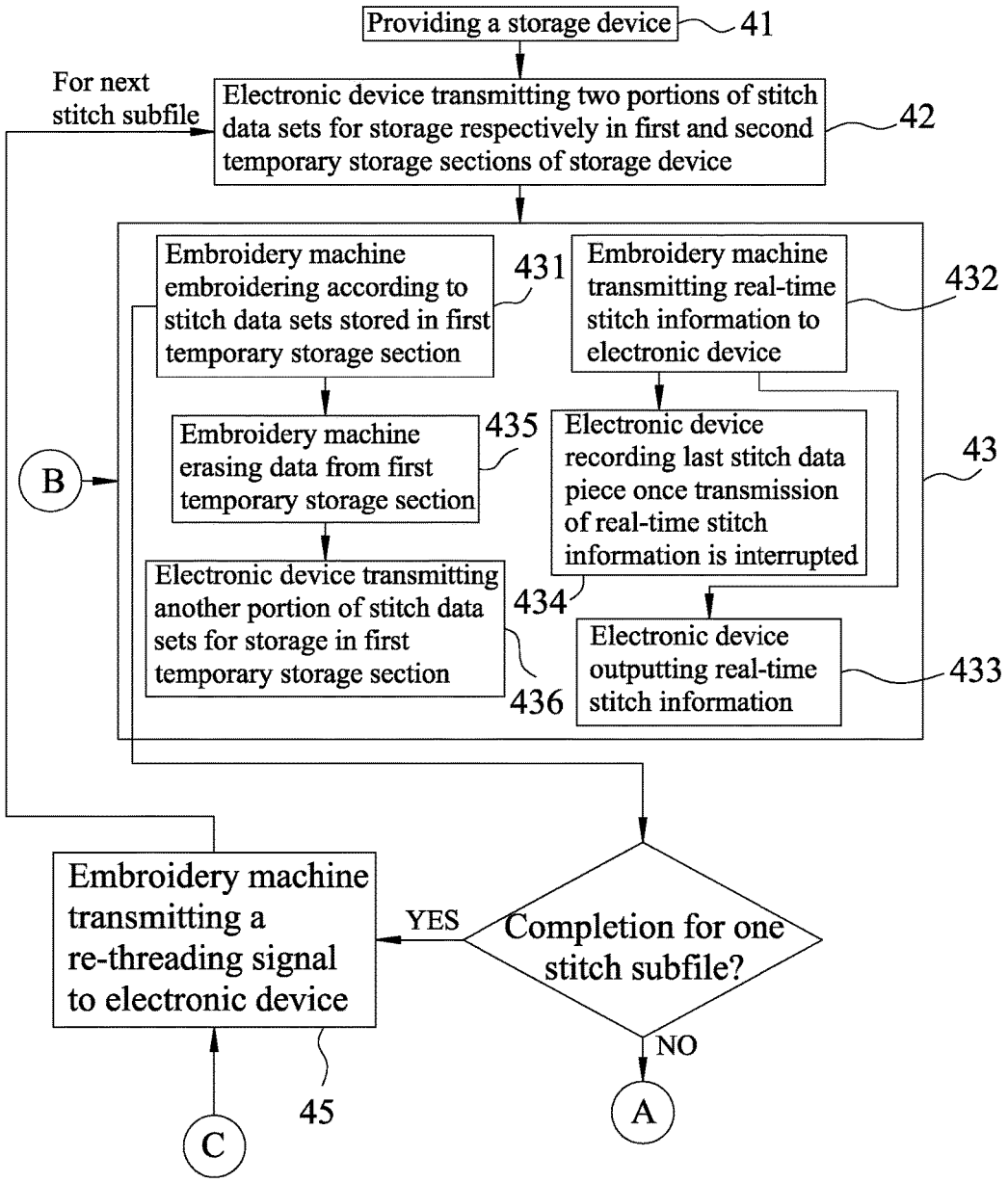
FIGS. 1A and 1B are flow charts illustrating steps of an embodiment of the operating method for computerized machine embroidery according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 1B:
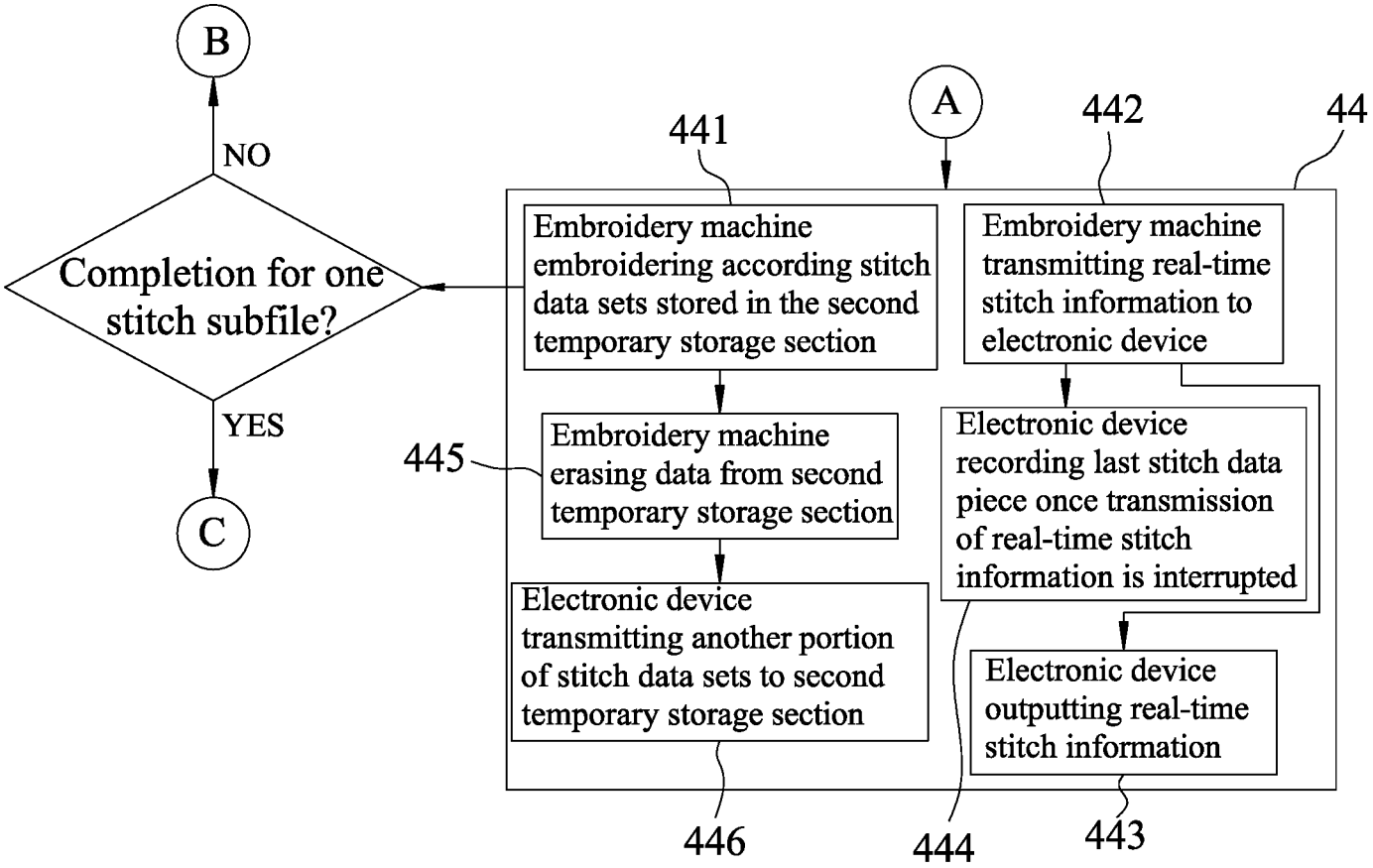
Figure 2:
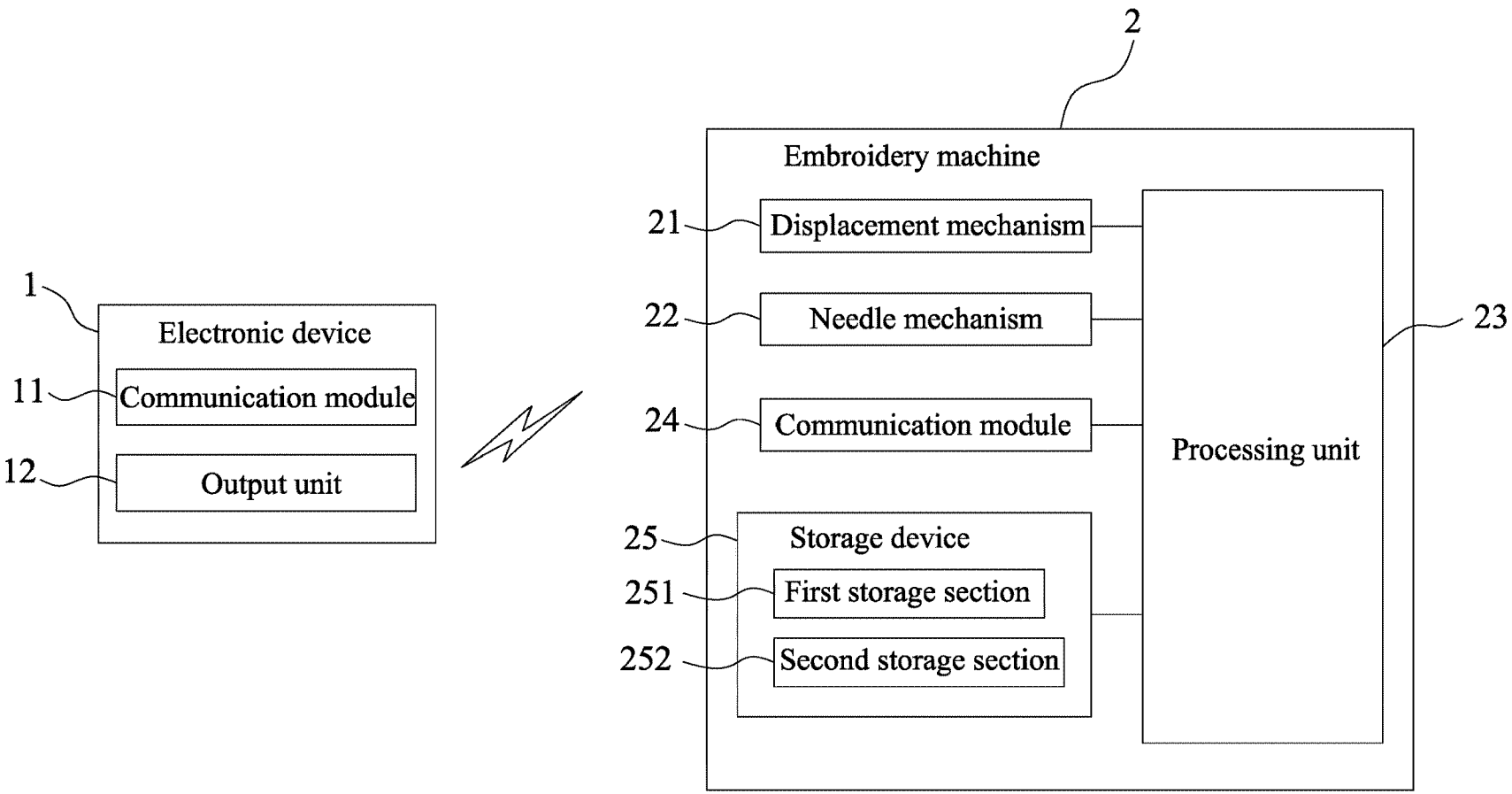
FIG. 2 is a block diagram illustrating an electronic device and an embroidery machine that cooperatively implement the embodiment.

Referring to FIGS. 1A, 1B and 2, the embodiment of an operating method for computerized machine embroidery is implemented by an electronic device 1 and an embroidery machine 2. In this embodiment, the embroidery machine 2 is a computerized embroidery machine. The electronic device 1 may be a computing device such as a smartphone, a tablet computer, a laptop computer, a desktop computer, etc., and includes a communication module 11 and an output unit 12 (e.g., a display device, a speaker, etc.). The embroidery machine 2 includes a displacement mechanism 21 of an embroidery plate, a needle mechanism 22, a processing unit 23, and a communication module 24. The displacement mechanism 21 is configured for clamping and bringing a fabric into movement. The needle mechanism 22 cooperates with the displacement mechanism 21 to embroider on the fabric. The processing unit 23 is electrically coupled to the displacement mechanism 21, the needle mechanism 22 and the communication module 24, and controls operations of the same. The communication modules 11, 24 are communicatively coupled together by either wired connection or wireless communication. In this embodiment, communication between the communication modules 11, 24 are established through a wireless communication protocol, such as WiFi, Bluetooth, ZigBee, etc.

The embodiment of the operating method includes steps 41-45.

Step 41: A storage device 25 is provided to be electrically coupled to the communication module 24 and the processing unit 23. In this embodiment, the storage device 25 is a RAM device divided into two or more temporary storage sections.

Step 42: The electronic device 1 transmits stitch data sets of a stitch file to the embroidery machine 2 via the communication modules 11, 24, and the processing unit 23 stores two portions of the stitch data sets respectively into a first temporary storage section 251 and a second temporary storage section 252 of the storage device 25. In detail, the embroidery machine 2 stores a portion (e.g., a first portion) of the stitch data sets into the first temporary storage section 251 until the first temporary storage section 251 is full, and the embroidery machine 2 then stores another portion (e.g., a second portion) of the stitch data sets into the second temporary storage section 252 until the second temporary storage section 252 is full. The electronic device 1 pauses the transmission of the stitch data sets when the second temporary storage section 252 is full. The stitch file includes multiple stitch subfiles respectively corresponding to different thread colors. Each stitch subfile includes a plurality of stitch data sets, and each stitch data set includes a plurality of stitch data pieces each being associated with a position of the displacement mechanism 21 and speeds of the displacement mechanism 21 and the needle mechanism 22. In this embodiment, each stitch data piece is composed of five bytes, four of which store two-dimensional coordinates (X, Y) corresponding to the position of the displacement mechanism 21, and the other one of which stores speed codes associated with operation speeds of the displacement mechanism 21 and the needle mechanism 22. It is noted that the stitch file may include only one stitch subfile that corresponds to a single thread color.

Step 43 includes sub-steps 431-436. In sub-step 431, the processing unit 23 executes a portion (e.g., the first portion) of the stitch data sets that is stored in the first temporary storage section 251, thereby driving the displacement mechanism 21 and the needle mechanism 22 to embroider a fabric based on the stitch data pieces stored in the first temporary storage section 251 in sequence. For example, when the coordinates of the displacement mechanism 21 indicated by first to tenth stitch data pieces are respectively $(X_1, Y_1)$, $(X_2, Y_2)$ . . . and $(X_{10}, Y_{10})$, the displacement mechanism 21 moves to $(X_1, Y_1)$, to $(X_2, Y_2)$ . . . and to $(X_{10}, Y_{10})$ in sequence.

In sub-step 432, the processing unit 23 transmits real-time stitch information associated with the embroidering performed by the displacement mechanism 21 and the needle mechanism 22 to the electronic device 1 during the embroidering process. The real-time stitch information may include at least one of a stitch count that has been executed, an embroidery pattern that has been completed, a color of thread that is currently being used by the needle mechanism 22, and a position of the displacement mechanism 21, and is synchronous with the operations of the embroidery machine 2.

Figure 3:
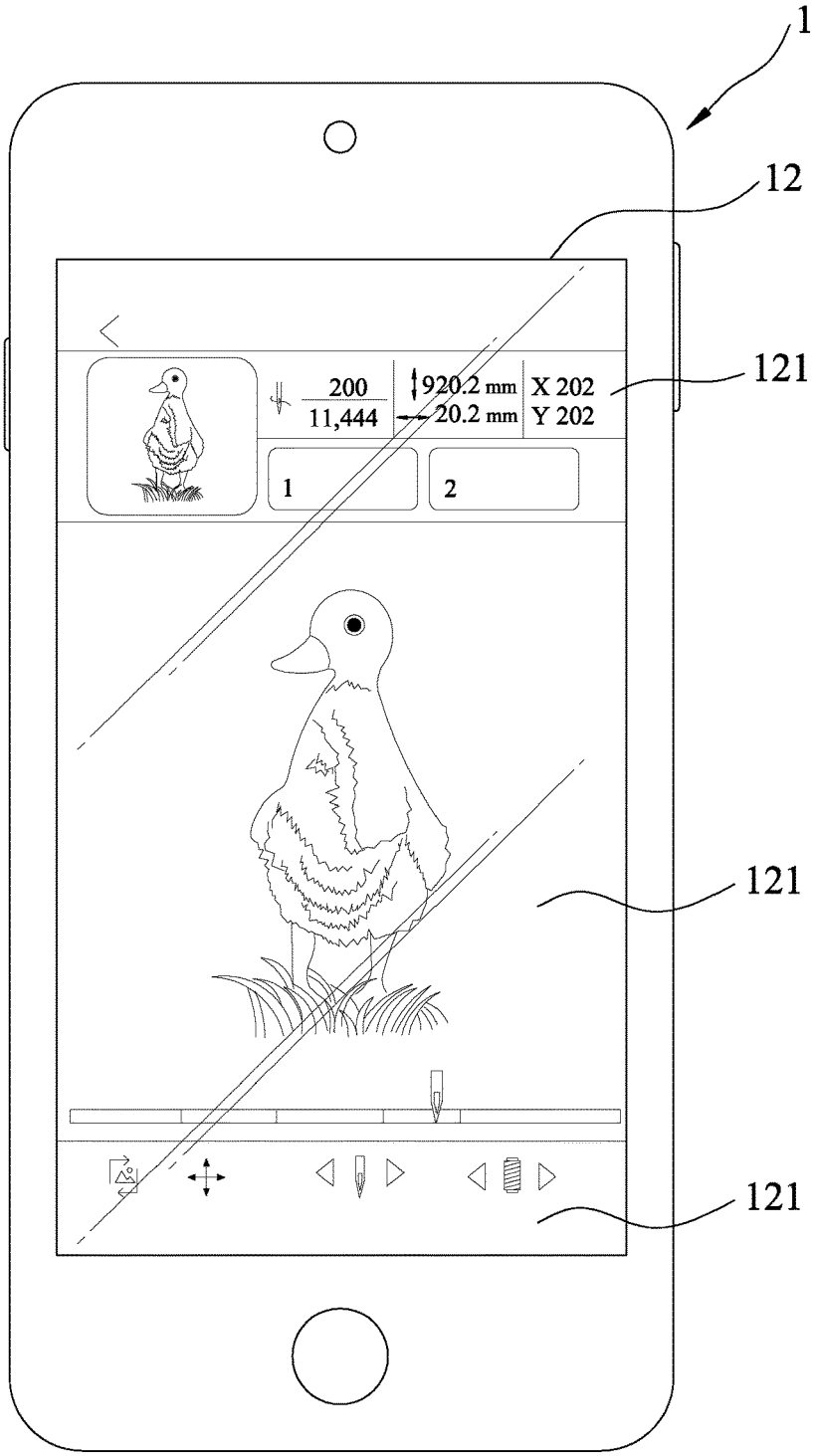
FIG. 3 is a schematic diagram exemplarily illustrating the electronic device with a graphic interface that shows visual information associated with real-time stitch information.

In sub-step 433, the output unit 12 outputs at least one of visual information or audio information that is associated with the real-time stitch information. Further referring to FIG. 3, for example, the output unit 12 includes a graphic interface that is divided into multiple display regions 121 to respectively display different content included in the visual information associated with the real-time stitch information. Accordingly, users may be aware of the current progress of the embroidering process (e.g., the color of thread that is currently being used, previewing of the embroidery pattern that has been completed thus far) via the display regions 121 of the output unit 12.

In sub-step 434, once the transmission of the real-time stitch information to the electronic device 1 during the embroidering process is interrupted, the electronic device 1 records a last stitch data piece based on which the embroidery machine 2 performed the embroidering before the interruption of the transmission of the real-time stitch information; then, the electronic device 1 re-transmits, to the storage device 25, the stitch data pieces starting from one of the stitch data pieces that is next to said last stitch data piece recorded by the electronic device 1 (i.e., transmitting the stitch data pieces to the embroidery machine 2 via the communication modules 11, 24 and the processing unit 23 stores the stitch data pieces in the storage device 25) after the embroidery machine 2 is rebooted. For example, when the operation of the embroidery machine 2 is abnormally interrupted due to power failure, emergency shutdown, etc., so that the embroidery machine 2 is unable to transmit the real-time stitch information to the electronic device 1, the electronic device 1 records the last stitch data piece based on which the embroidery machine 2 has embroidered. In the following description, said last stitch data piece is named $D_n$. When the embroidery machine 2 is rebooted and thus operates in a normal condition, data previously stored in the storage device 25, which is a RAM device in this embodiment, may be lost or the storage device 25 may be reset to a default state, and the electronic device 1 causes a stitch data piece $(D_{(n+1)})$ that is next to the stitch data piece $(D_n)$ to be a start of data transmission, and transmits the stitch data pieces $(D_{(n+1)}, D_{(n+2)}, D_{(n+3)}$ . . . ) in sequence for storage in the first temporary storage section 251 until the first temporary storage section 251 is full, followed by continuing the transmission of other stitch data pieces sequential to those stored in the first temporary storage section 251 for storage in the second temporary storage section 252 until the second temporary storage section 252 is full. The data transmission in this step is similar to that described in step 42. Accordingly, the embroidery machine 2 may resume the embroidering from the stitch data piece $D_{(n+1)}$. In addition, if the user wishes to restart a new embroidery process on another fabric after the embroidery machine 2 returns to the normal condition, the user may use the electronic device 1 to re-transmit the stitch file to the embroidery machine 2 from the beginning instead of starting data transmission from the stitch data piece $D_{(n+1)}$. It is noted that the sub-step 434 is not necessary, and may be omitted if the abnormal interruption does not happen during the embroidering process.

In sub-step 435, the processing unit 23 erases data (e.g., the first portion of the stitch data sets) from the first temporary storage section 251 after completion of the embroidering in step 431 according to the portion (e.g., the first portion) of the stitch data sets that is stored in the first temporary storage section 251.

In sub-step 436, the electronic device 1 transmits a resuming signal to the electronic device 1 after data stored in the first temporary storage section 251 has been erased in sub-step 435; upon receipt of the resuming signal, the electronic device 1 picks up transmission of the stitch data sets from where the electronic device 1 had left off to transmit another portion of the stitch data sets to the embroidery machine 2 (i.e., resuming the transmission of the stitch data sets that is paused in step 42 or step 446, which will be described hereinafter) to the now-empty first temporary storage section 251 until the first temporary storage section 251 is full. The electronic device 1 pauses the transmission of the stitch data sets when the first temporary storage section 251 is full.

In addition to sub-step 435, the embroidery machine 2 also performs step 44, which includes sub-steps 441-446, after completion of the embroidering in step 431 according to the portion (e.g., the first portion) of the stitch data sets that is stored in the first temporary storage section 251 prior to the erasing.

In sub-step 441, the processing unit 23 drives the displacement mechanism 21 and the needle mechanism 22 to embroider on the fabric according to a portion (e.g., the second portion) of the stitch data sets that is stored in the second temporary storage section 252.

In sub-step 442, the processing unit 23 transmits the real-time stitch information as described for sub-step 432.

In sub-step 443, the output unit 12 outputs at least one of visual information or audio information that is associated with the real-time stitch information as described for sub-step 433.

In sub-step 444, which is similar to sub-step 434, once the transmission of the real-time stitch information to the electronic device 1 during the embroidering is interrupted, the electronic device 1 records a last stitch data piece based on which the embroidery machine 2 performed the embroidering before the interruption of the transmission of the real-time stitch information; then, the electronic device 1 transmits the stitch data pieces starting from one of the stitch data pieces that is next to said last stitch data piece recorded by the electronic device 1 for storage in the storage device 25 after the embroidery machine 2 is rebooted.

In sub-step 445, the processing unit 23 erases data (e.g., the second portion of the stitch data sets) from the second temporary storage section 252 after completion of the embroidering in step 441 according to the portion (e.g., the second portion) of the stitch data sets that is stored in the second temporary storage section 252.

In sub-step 446, the electronic device 1 transmits the resuming signal to the electronic device 1 after data stored in the second temporary storage section 252 has been erased in sub-step 445; upon receipt of the resuming signal, the electronic device 1 picks up transmission of the stitch data sets from where the electronic device 1 had left off to transmit another portion of the stitch data sets to the embroidery machine 2 (i.e., resuming the transmission of the stitch data sets that is paused in step 436) to the now-empty second temporary storage section 252 until the second temporary storage section 252 is full. The electronic device 1 pauses the transmission of the stitch data sets when the second temporary storage section 252 is full.

The embroidery machine 2 completes the embroidery process corresponding to each of the stitch subfiles by repeating steps 43 and 44. For example, after step 42, the embroidery machine 2 embroiders according to the first portion of the stitch data sets of a first one of the stitch subfiles stored in the first temporary storage section 251 (sub-step 431); after completion of the embroidering according to the first portion of the stitch data sets, the embroidery machine 2 continues embroidering according to the second portion of the stitch data sets of the first one of the stitch subfiles stored in the second temporary storage section 252 (sub-step 441), erases data from the first temporary storage section 251 (sub-step 435), and transmits the resuming signal such that the electronic device 1 resumes transmission of the stitch data sets of the first one of the stitch subfiles by transmitting a next portion (i.e., a third portion) of the stitch data sets of the first one of the stitch subfiles to the first temporary storage section 251 (sub-step 436). After completion of the embroidering according to the second portion of the stitch data sets of the first one of the stitch subfiles, the embroidery machine 2 continues embroidering according to the third portion of the stitch data sets of the first one of the stitch subfiles stored in the first temporary storage section 251 (going back to sub-step 431), erases data from the second temporary storage section 252 (sub-step 445), and transmits the resuming signal such that the electronic device 1 resumes transmission of the stitch data sets of the first one of the stitch subfiles by transmitting a next portion (i.e., a fourth portion) of the stitch data sets of the first one of the stitch subfiles to the second temporary storage section 252 (sub-step 446). The abovementioned process repeats until the entire embroidery process corresponding to the first one of the stitch subfiles completes, and the flow then goes to step 45.

In step 45, the processing unit 23 transmits a re-threading signal to the electronic device 1 for notifying the user to re-thread the embroidery machine 2 with a thread of another color that corresponds to a next one (e.g., the second one) of the stitch subfiles upon completion of the embroidering corresponding to the first one of the stitch subfiles. The steps 42-45 may repeat for each stitch subfile until completion of embroidery of the entire embroidery pattern corresponding to the stitch file. It is noted that, when the embroidery pattern corresponding to the stitch file has only a single color, the stitch file would include only one stitch subfile, and step 45 is omitted.

In summary, the embodiment may have the following advantages:

1. By virtue of the processing unit 23 alternately executing the stitch data pieces stored in the temporary storage portions 251, 252, the embroidering of an embroidery pattern corresponding to a stitch file with a file size bigger than the capacity of the RAM device of the embroidery machine 2 may be realized. Accordingly, a low-end embroidery machine that has a relatively small capacity of the RAM device may be able to embroider a fine, gorgeous, complicated embroidery pattern.

2. Through the processing unit 23 transmitting the real-time stitch information, the electronic device 1 may acquire substantially instant progress of the embroidering in sync. In a case that the electronic device 1 communicates with the embroidery machine 2 using wireless technology, the user may be aware of the embroidering process remotely without staying by the embroidery machine 2.

3. By virtue of the electronic device 1 recording the (last) stitch data piece at the time the transmission of the real-time stitch information is abnormally interrupted, the embroidery machine 2 may resume the embroidering after rebooting, thereby avoiding fabric waste and time waste resulting from re-embroidering the same pattern on another fabric.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. An operating method for computerized machine embroidery, comprising steps of:

(a) an electronic device transmitting stitch data sets of a stitch file to an embroidery machine, and the embroidery machine storing two portions of the stitch data sets respectively into a first storage section and a second storage section;

(b) the embroidery machine embroidering according to the portion of the stitch data sets that is stored in the first storage section;

(c) after completion of step (b), the embroidery machine erasing the portion of the stitch data sets from the first storage section;

(d) after completion of step (c), the electronic device transmitting a remaining portion of the stitch data sets to the embroidery machine, and the embroidery machine storing the remaining portion of the stitch data sets into the first storage section;

(e) after completion of step (b), the embroidery machine embroidering according to the portion of the stitch data sets that is stored in the second storage section; and (f) repeating step (b) after completion of steps (d) and (e).

2. The operating method of claim 1, wherein step (f) includes repeating steps (b) to (d) after completion of steps (d) and (e), and said operating method further comprises steps of:

(g) after completion of step (e), the embroidery machine erasing the portion of the stitch data sets from the second storage section;

(h) after completion of step (g), the electronic device transmitting another portion of the stitch data sets to the embroidery machine, and the embroidery machine storing the another portion of the stitch data sets into the second storage section;

(i) repeating steps (e), (g) and (h) after completion of steps (b) and (h); and (j) repeating steps (f) and (i) until the embroidery machine completes embroidering according to all of the stitch data sets.

3. The operating method of claim 2, wherein step (a) includes sub-steps of: (a-1) the embroidery machine storing a first portion of the stitch data sets into the first storage section until the first storage section is full; and (a-2) after sub-step (a-1), the embroidery machine storing a second portion of the stitch data sets into the second storage section until the second storage section is full.

4. The operating method of claim 3, wherein step (a) further includes a sub-step of: (a-3) the electronic device pausing the transmission of the stitch data sets when the second storage section is full in sub-step (a-2);

step (d) includes sub-steps of: (d-1) the electronic device resuming the transmission of the stitch data sets to the embroidery machine; and (d-2) the embroidery machine storing a portion of the stitch data sets transmitted in sub-step (d-1) into the first storage section until the first storage section is full; and step (h) includes sub-steps of: (h-1) the electronic device resuming the transmission of the stitch data sets to the embroidery machine; and (h-2) the embroidery machine storing a portion of the stitch data sets transmitted in sub-step (h-1) into the second storage section until the second storage section is full.

5. The operating method of claim 1, wherein each of the first and second storage sections is a temporary storage section of a random access memory device.

6. The operating method of claim 1, wherein at least one of step (b) or step (e) includes a sub-step of the embroidery machine transmitting a real-time stitch information associated with the embroidering of the embroidery machine to the electronic device during the embroidering, the real-time stitch information includes at least one of a stitch count that has been executed, an embroidery pattern that has been completed, a color of thread that is currently used by a needle mechanism of the embroidery machine, and a position of a displacement mechanism of an embroidery plate of the embroidery machine.

7. The operating method of claim 6, wherein the sub-step of the embroidery machine transmitting the real-time stitch information to the electronic device during the embroidering further includes the electronic device outputting at least one of visual information or audio information that is associated with the real-time stitch information.

8. The operating method of claim 6, wherein each of the stitch data sets includes a plurality of stitch data pieces, and each of the first and second storage sections is a temporary storage section of a random access memory device; and at least one of step (b) or step (e) further includes sub-steps of:

once the transmission of the real-time stitch information to the electronic device during the embroidering is interrupted, the electronic device recording a last stitch data piece based on which the embroidery machine has embroidered before the interruption; and the electronic device transmitting the stitch data pieces starting from one of the stitch data pieces that is next to the last stitch data piece recorded by the electronic device to the embroidery machine after the embroidery machine returns to normal operation, and the embroidery machine stores the stitch data pieces transmitted by the electronic device into the random access memory device.

9. The operating method of claim 1, wherein step (d) further includes the embroidery machine transmitting a resuming signal to the electronic device, and the electronic device transmitting the remaining portion of the stitch data sets to the embroidery machine upon receipt of the resuming signal.

10. The operating method of claim 1, wherein the stitch file includes at least one stitch subfile that corresponds to a thread color, and said operating method further comprises a step of the embroidery machine transmitting a re-threading signal to the electronic device for notifying a user to re-thread the embroidery machine upon completion of embroidering corresponding to the stitch subfile.

* * * * *